United States Patent [19]

Niemeyer

[11] Patent Number: 4,951,664

[45] Date of Patent: Aug. 28, 1990

[54] MASK AND METHOD OF MANUFACTURE

[75] Inventor: Trenton A. Niemeyer, St. Paul, Minn.

[73] Assignee: Filcon Corporation, St. Paul, Minn.

[21] Appl. No.: 242,720

[22] Filed: Sep. 9, 1988

[51] Int. Cl.[5] ..... A62B 18/08

[52] U.S. Cl. ..... 128/206.24; 128/205.27

[58] Field of Search ..... 128/206.24, 205.27, 128/205.29, 206.12, 206.16, 206.17

[56] References Cited

U.S. PATENT DOCUMENTS

| | | | |
|---|---|---|---|
| 2,765,788 | 10/1956 | Raiche | 128/206.24 |
| 2,931,356 | 8/1958 | Schwarz | 128/206.19 |
| 3,521,630 | 7/1970 | Westberg et al. | 128/206.24 |
| 3,757,777 | 9/1973 | Kaufman | 128/206.24 |
| 3,974,829 | 8/1976 | Tate, Jr. | 128/139 |
| 4,454,881 | 6/1984 | Huber et al. | 128/206.24 |
| 4,628,927 | 12/1986 | Ward | 128/206.19 |

FOREIGN PATENT DOCUMENTS

| | | | |
|---|---|---|---|
| 117262 | 7/1943 | Australia | 128/206.24 |
| 665400 | 11/1934 | Fed. Rep. of Germany | 128/206.24 |
| 677088 | 5/1939 | Fed. Rep. of Germany | 128/206.24 |
| 702315 | 1/1941 | Fed. Rep. of Germany | 128/206.24 |
| 1806129 | 11/1969 | Fed. Rep. of Germany | 128/206.24 |
| 209470 | 7/1940 | Switzerland | 128/206.24 |
| 425152 | 3/1935 | United Kingdom | 128/206.24 |
| 425744 | 3/1935 | United Kingdom | 128/206.24 |
| 1077791 | 9/1967 | United Kingdom | 128/206.24 |

OTHER PUBLICATIONS

Exhibit A–Photographs of 3m Mask.

*Primary Examiner*—Edgar S. Burr
*Assistant Examiner*—Aaron J. Lewis
*Attorney, Agent, or Firm*—James V. Harmon

[57] ABSTRACT

A mask for filtering dust and other particulates from air to be breathed by a person and a process for making same. The mask includes a compressible strip covered partially by a sealing material around the entire contact path between the mask and the person's face. The compressible strip provides for changes in the configuration of the face, while the impermeable material maintains a seal during all such changes. Another embodiment includes a support for said compressible strip either in the form of a semi-rigid frame member behind said strip or a plurality of inwardly cantilevered bendable finger members.

13 Claims, 5 Drawing Sheets

FIG. 1
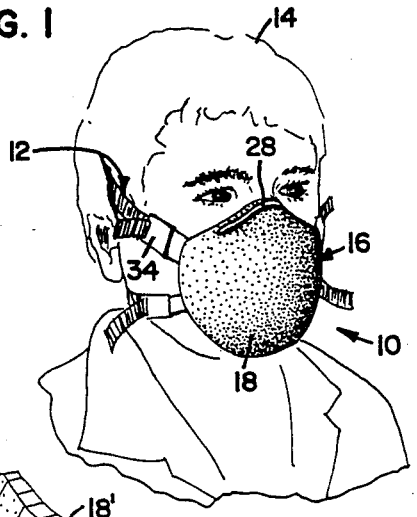
FIG. 3
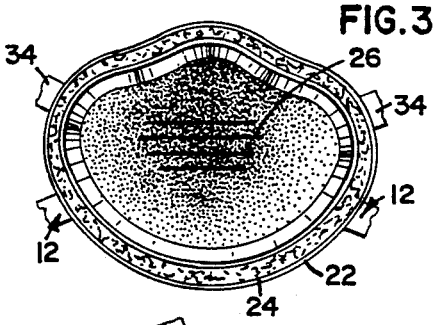
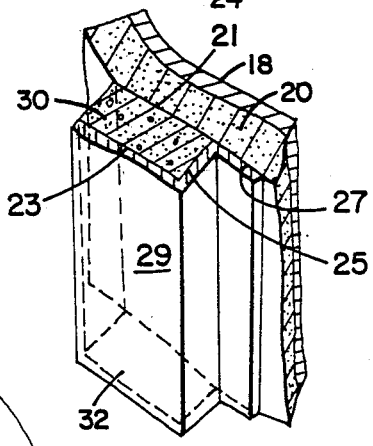
FIG. 4
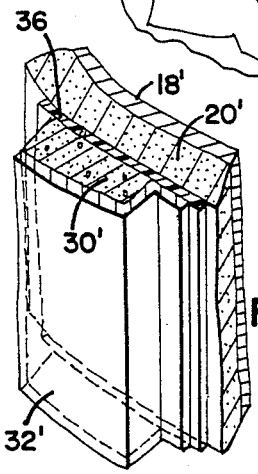
FIG. 5
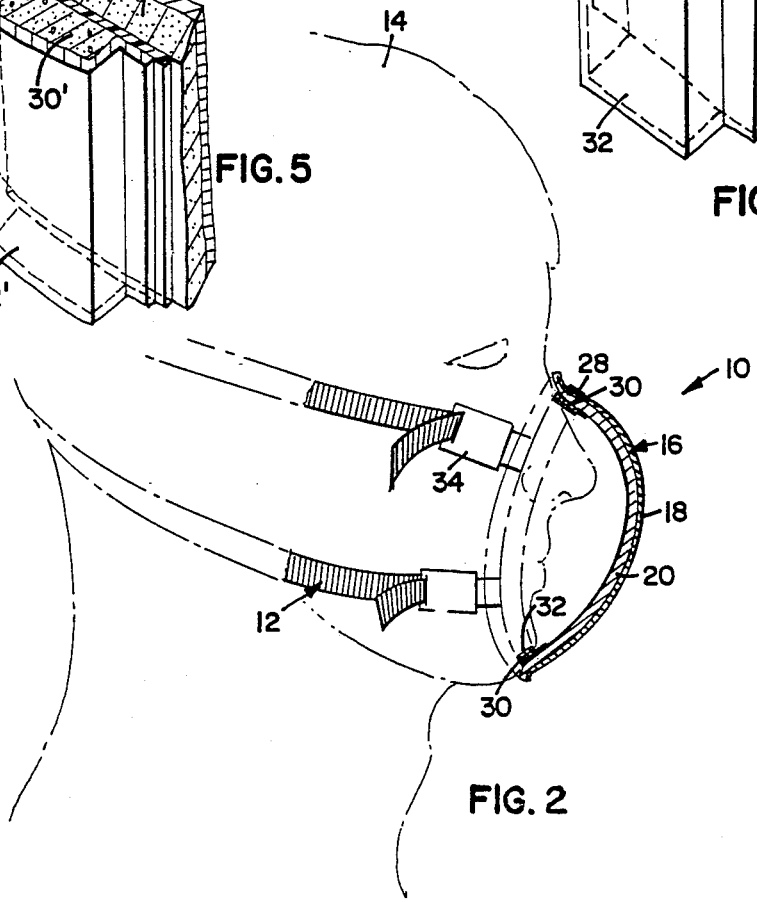
FIG. 2

FIG. 11
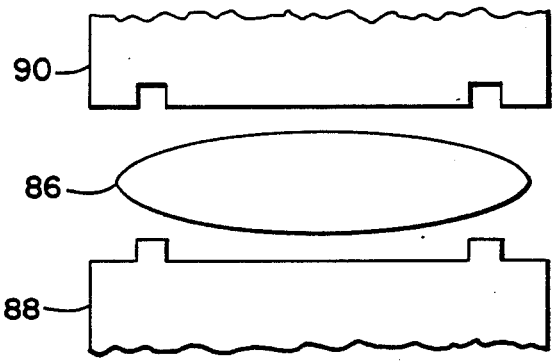
FIG. 12
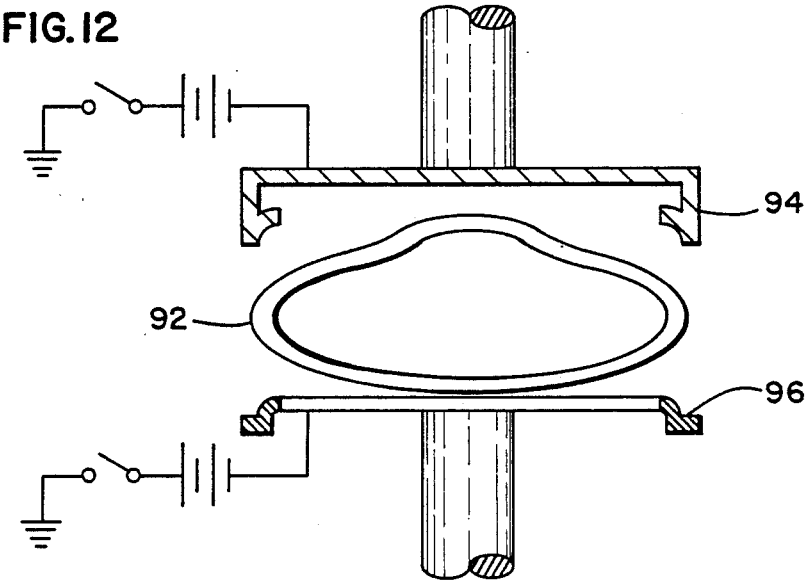
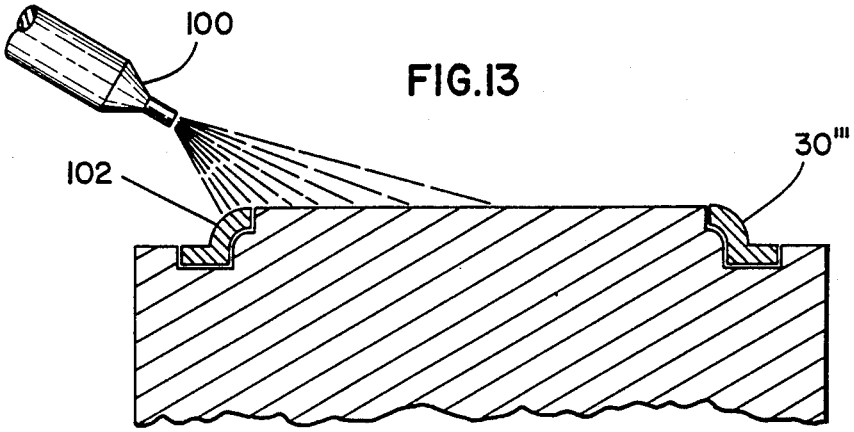
FIG. 13

MASK AND METHOD OF MANUFACTURE

The present application is a continuation-in-part of U.S. application Ser. No. 096,077, filed 9/11/87, now abandoned, which was a continuation-in-part of U.S. application Ser. No. 925,288, filed 10/31/86, now abandoned.

FIELD OF THE INVENTION

The present invention is directed to a mask for filtering dust and other particulates from air.

BACKGROUND OF THE INVENTION

Masks for filtering dust and other particulates from air are known. In particular, a known mask has a hump-shaped, pliant layer of filter material formed to have an irregularly shaped perimeter to conform relatively closely to a person's face. The mask forms an enclosure about the person's nose and mouth. The known mask includes a short piece of foam-like material in a region where the mask contacts the person's nose. Apparently, the foam-like material functions as a padding. A pair of straps are attached to the mask for holding the mask to the person's head.

The problem with the known mask is that different people have different face configurations and, for that matter, the face configuration of a particular person changes as he breathes, talks, grimaces, or even as he becomes fatigued during working, so that the known mask does not always conform to these various configurations and provide an appropriate seal. More subtly and more importantly, leakage may occur during normal breathing due to the natural spherical concavity formed by the position of the cheekbone, the teeth, and the outer part of the jaw on both sides of the wearer's face. A pliant, muscular tissue covers these concavities to form the cheek. During inhalation, the pressure differential is such that it creates an external force pushing against the cheek area and forcing the cheek tissue inward toward the inside of the mouth. During this process, the cheek tissue may be separated slightly from the perimeter of the known mask. Any slight separation provides an opening so that the small particulates which the mask is intended to filter may be forced into the space enclosed by the mask by the higher pressure which is outside the mask. The problem increases in magnitude anytime the jaw drops thereby increasing the area and depth of the indicated concavity. Although the indicated problem is subtle, the particles which are to be filtered are smaller than the eye can see, and over time this deficiency in the known mask could lead to a serious situation.

Consequently, although the known mask meets the efficiency requirements with respect to the filter material, the mask system which includes attachment to the wearer, often has a much lower efficiency since there either is an inadequate seal between the person's face and the mask at the time the mask is put on, or an inadequate seal develops at various times during the wearing.

In this regard, it has been recognized that a half mask respirator, i.e., one that encloses a person's nose and mouth, can provide much improved protection if anthropological characteristics of people are taken into consideration. See "Fit Factors of an Anthropometrically Designed Three Size Half Mask", Jones, J. A., Brissette, J. E. and Holm, J. M., Journal of the International Society for Respiratory Protection, Volume 5, Issue 4, Oct.-Dec. 1987.

Even considering such fit factors, however, leakage is still a substantial concern. In the authoritative "NIOSH Guide to Industrial Respiratory Protection" Bollinger, N.J., and Schutz, R. H., Department of Health and Human Services, Sept. 1, 1987, it was stated that "no qualitative or quantitative fit tests have been demonstrated to be capable of effectively identifying inadequately fitting respirators." In that regard, the document further indicates, as do publications in the *Federal Reqister*, that NIOSH, the National Institute for Occupational Safety and Health, is trying to establish significant revisions to 30 C.F.R. part 11, which will become 42 C.F.R. part 84 regarding federal certification for respirators. Apparently, when the new 42 C.F.R. part 84 is approved, it will include the Jones et. al. fit factors as criteria. Nevertheless, industry and government are extremely concerned over respirator leakage and it is clear that subtle changes in design may prove very significant and even life-saving.

SUMMARY OF THE INVENTION

The present invention is directed to solving face-fit problems. In this regard, the present mask includes mechanism for filtering dust and other particulates from air, as well as mechanism for pliably conforming the mask to a person's face and mechanism for sealing between the person's face and the filtering mechanism.

In one embodiment, the filtering mechanism is formed as a hump-shaped, pliant layer of first material wherein the layer has an irregularly shaped perimeter to substantially conform to the person's face so that the hump-shaped layer encloses the person's nose and mouth. The conforming mechanism is then attached to the filtering mechanism in an endless strip of second material near the perimeter of the first material. The sealing mechanism is impenetrable to the dust and other particulates intended to be filtered from the air. The sealing mechanism is endless and is attached to both the strip of second material and to the first material.

More particularly, the endless strip of second material may be formed from a rectangular cross-sectional shaped, foam-like material which will readily compress and expand to conform to a person's face. One side of the strip is attached to the filter material. A third material, comprising the sealing mechanism, is attached to the side of the foam strip opposite the side attached to the filter material and extends for attachment to the filter material. In this way, the impenetrable material is in contact with the person's face, and provides a seal between the face and the filter material. One side of the foam material is left free of the impenetrable material so that air may be forced out of or absorbed into the foam material during compression and expansion.

The present invention is particularly advantageous in that the foam material allows the mask to conform to the person's face, including the concavities therein, during various configurations of the face. Furthermore, the seal between the face and the filter material is maintained as a result of the elastic, yet impenetrable, third material. Thus, with the present mask, the filter material can be made to perform not only to a high efficiency, but such efficiency can be maintained by minimizing the likelihood of violations of seal integrity between the wearer's face and the filter material. Significantly, the advantages of the present invention are possible without requiring expensive design details or manufacturing steps.

In a another embodiment, a frame of relatively rigid material is installed between the foam and the filter material of the mask to provide a rigid surface against which the foam may be compressed. In yet another embodiment, the filter function is provided by a smaller pad of filter material which is replaceable within a window-like frame and held in place by a cover. The window-like frame is formed as a part of a relatively rigid shell. Since the foam and sealing mechanism of the third material is attached to the shell rather than relatively flexible filter materials, the foam compresses against the shell in a fashion similar to the way it compresses against the relatively rigid frame of the earlier described embodiment.

In still another embodiment, a support for the foam is formed by a plurality of flexible, cantilevered fingers which are attached to a strip fastened to either the relatively rigid frame or shell or the hump-shaped filter material.

The method of manufacture of the present mask insures impermeability of air during a breathing cycle across the conforming mechanism and the sealing mechanism. Rather than separately form a sealing material and attach it to the foam material and the filter or shell, the foam material is exposed to a liquid form of the seal material which, when cured, adheres strongly to the foam material and provides the desired characteristics as described. The liquid seal material is either sprayed on the foam material and filter material as required, or the appropriate elements are dipped in a liquid bath.

The novel method of manufacture is necessary because the choice of a third material sealing rubber is critical to successful sealing of the mask. True conformability requires an elastomer with zero load transfer, i.e., a sheet of the material can be folded without any resistance. Contrarily, elastomers containing hardeners and additives stiffen and actually degrade their conformability and inhibit the conformability of the second material as well.

While the zero load transfer sealing material is advantageous, it can not retain its shape once it drys and so creates new manufacturing problems. Long drying times, if molding were used, is one. Piece-part extraction is another. Direct application to the foam in a liquid form, however, eliminates these problems.

The present method of manufacture is also inherently advantageous because the sealing material is self-adhering when in a liquid state. This eliminates the need for an additional manufacturing step of applying a separate adhesive, thus resulting in economic cost savings.

These advantages and objectives of the present invention can be better understood by reference to the drawings, briefly described hereinafter, and by reference to the detailed description of the preferred and other embodiments which follows thereafter and refers to the drawings.

BRIEF DESCRIPTION OF THE DRAWINGS

FIG. 1 is a perspective view of a person wearing a mask in accordance with the present invention;

FIG. 2 is a side view of the person and mask of FIG. 1, showing the mask in cross-section;

FIG. 3 is a plan, rear view of the mask;

FIG. 4 is a cross-sectional view, in perspective, of a portion of the mask which includes the sealing mechanism;

FIG. 5 is a cross-sectional view, in perspective, similar to FIG. 4 of an alternate embodiment;

FIGS. 11–16 illustrate steps and alternate steps of the method of manufacture of a mask in accordance with the present invention.

DETAILED DESCRIPTION OF THE PREFERRED EMBODIMENT

Figure 6:
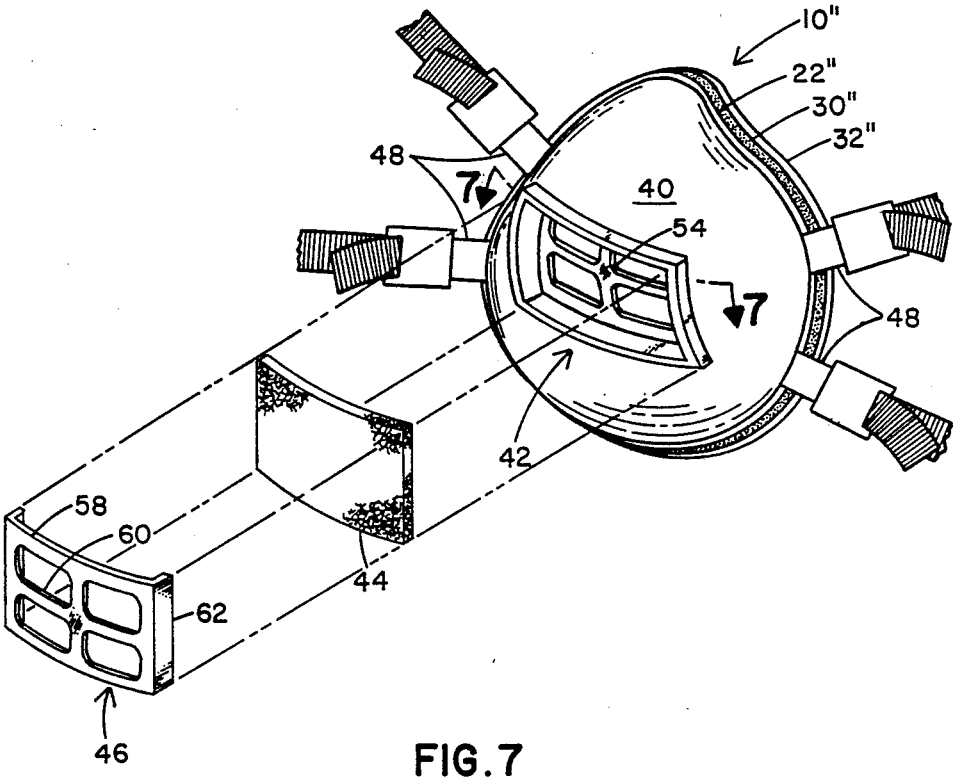
FIG. 6 is an exploded perspective view of another alternate embodiment mask in accordance with the present invention.

Referring now to the drawings wherein like reference numerals designate identical or corresponding parts throughout the several views, and more particularly to FIG. 1, a mask in accordance with the present invention is designated generally by the numeral 10. Mask 10 is held by straps 12 to the face of person 14 so as to enclose the person's nose and mouth.

As shown in FIG. 2, mask 10 includes a layer 16 of first materials which function to filter dust and other particulates from air. As shown, layer 16 commonly includes an outer material 18 and an inner material 20. In addition, it is understood that additional sheets of filtering first materials may be included as a part of layer 16. Each sheet of a first material may filter a different size of a different type of particle from air passing therethrough. In addition, a plurality of sheets provides for the possibility of creating an air space between adjacent sheets so as to serve a further settling and filtering function.

Layer 16 is formed to have a hump-like shape so as to enclose the nose and mouth, but not contact them, when the mask is against the person's face. The filtering layer is pliant and has a perimeter 22 which is irregularly shaped to conform substantially to a person's face. A seam 24 near perimeter 22 attaches the various first materials together. In addition, ridges or grooves 26 may be formed in one or more of the first materials of layer 16 to provide structure for maintaining the shape of mask 10. A metallic member 28 may be attached with adhesive or in another known fashion to outer material 16 so as to fit over the nose of person 14. Member 28 is preferably readily malleable by hand so as to easily conform mask 10 to the bridge of the nose.

Strip 30 is fastened with an adhesive or another known fastening mechanism to the inner material 20 of filtering layer 16 near perimeter 22. Strip 30 forms an endless path. Strip 30 is preferably made from an open cell foam second material and, preferably, has a rectangular cross-sectional shape. It is understood, however, that other cross-sectional shapes may function as well. In particular, it is only necessary that strip 30 have a first portion facing at least partially toward space enclosed by layer 16 and a second portion facing at least partially away from space enclosed by layer 16. The second material must allow air to be forced out of or absorbed into it during compression and expansion, in contrast to a material which functions like a balloon and reshapes or displaces rather than compresses and expands.

A third material 32 also forms an endless path and attaches to both strip 30 and inner material 20. Third material 32 is elastic, impermeable to particles as small as 5 micron in any dimension or at least as small as particulates to be filtered by layer 16 and is so soft that as a uniform thickness sheet it cannot support its own weight, i.e., collapses under the force of gravity within a height above a support no greater than two thicknesses of material 32. An acceptable material is the rubber used in condoms and defined in ASTM Specification D 1076 available from ASTM Headquarters, 1916 Race St., Philadelphia, Pa. 19103. Acceptable rubbers must be hypo-allergenic, such as latex or styrene-butadiene. Third material 32 must be elastic so as to stretch as strip 30 compresses or expands. Third material 32 must also be soft, as indicated, so that localized forces causing stretching are not transmitted so as to pull and tighten the third material and cause it to overpower the conforming characteristic of the second material and thereby allow leakage between third material 32 and the facial skin of the wearer.

As shown, strip 30 has a rectangular cross-sectional shape so that a first side 21 is attached to inner material 20. Third material 32 covers either a first or second portion of strip 30, or, more particularly, is attached to a second side 23 of strip 30 which is opposite from the first side 21 and to a third side 25, as well as to a portion 27 of inner material 20. In this way, the portion 29 of third material 32 attached to the second side of strip 30 contacts the face of person 14 and provides an efficient seal between the face and inner material 20.

One or more straps 12 are attached to opposite side edges of filtering layer 16 so that when straps 12 are placed around the head of person 14, mask 10 is held securely to his face. More importantly, straps 12 are elastic or include adjustment mechanisms 34 so that mask 10 is held so tightly to the face of person 14 that strip 30 compresses to the more solid portions of the face, such as the cheek bone and jaw, and conforms to the concavities of the face therebetween. As the configuration of the face changes or as masks are worn by different people, the compressibility of strip 30 provides for these various configurations and in conjunction with third material 32 maintains a seal thereby requiring breathable air to pass through filtering layer 16.

The elasticity of the third material allows it to follow the various shapes of compression and expansion of strip 30. That is, third material 32 maintains attachment to strip 30 and allows strip 30 to conform to the configurations of the face. In this regard, third material 32 must be so soft that it conforms to strip 30 and the face of the wearer and does not affect the performance of strip 30 during compression and expansion. An acceptable softness criteria is that third material 32 is sufficiently soft that it will not support its own weight. In this way, the load (compression or expansion) of one segment of third material 32 is only locally transferred and does not globally affect the entire strip of third material. While third material 32 in combination with strip 30 seals an expanding and contracting perimeter to the skin of the face, substantially stiffer or nonelastic materials do not allow a perimeter to expand and contract and maintain a seal and thus lead to gaps with the surface to be sealed or buckling of the material.

It is further noted that third material 32 may be generally on the side of the strip 30 facing toward the space enclosed by layer 16 or on the other side. The important criteria is that third material 32 is attached to the side of strip 30 opposite the side attached to inner material 20 so that it contacts the face and that at least one of the other sides is free of third material 32 so that air may be forced from or absorbed into the open cell foam strip 30 as it compresses and expands during wear.

To use, mask 10 is placed over the nose and mouth of person 14 and straps 12 are extended around his head. Straps 12 are adjusted so that third material 32 makes at least partial contact with the person's face all along the endless path of the third material. Also, strip 30 should be at least partially compressed all along its endless path. In that way, third material 32 forms an efficient seal thereby preventing undesirable particles from bypassing filtering layer 16 and for the most part requiring air to pass through filtering layer 16 before reaching the person's nose or mouth.

Over time, as the configuration of the person's face changes due to smiling, grimacing, talking, breathing, etc., the foam strip 30 compresses or expands, but third material 32 always maintains a seal. During compression and expansion, air can freely flow into or out of strip 30 through the side of strip 30 which is free of third material 32.

A first alternate embodiment of the present invention is indicated by the detail shown in FIG. 5. The embodiment of FIG. 5 is the same as the preferred embodiment of the other figures, except it includes a frame 36. For the sake of clarity, parts of the embodiment of FIG. 5 which correspond with parts of the preferred embodiment are designated by exactly the same numerals, only the numerals are primed.

Frame 36 is made of a substantially rigid material, like plastic, and shaped to substantially conform to the face of the mask wearer near the perimeter of the mask. Frame 36 may be made from a hand shaped, semi-rigid material. Preferably, frame 36 is endless and is fastened with adhesive or another known mechanism to the interior of the mask near the perimeter of the mask. Second and third materials 30' and 32' are then fastened to one another and to frame 36 in the same fashion as they are fastened to inner material 20 as described with respect to the preferred embodiment 10. In this way, frame 36 provides a more solid surface so that second material 30' may more readily compress between the face, especially the solid portions of the face, and frame 36. Alternately, frame 36 may be a hardened coating painted on filter material 20'.

Use of the first alternate embodiment is similar to the use of preferred embodiment 10.

Figure 7:
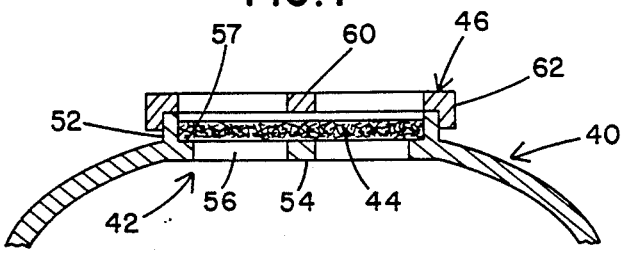
FIG. 7 is a cross-sectional view taken along line 7—7 of FIG. 6.

A second alternate embodiment of the present invention is shown in FIGS. 6–7. Parts of the second alternate embodiment which correspond with the preferred embodiment are designated by exactly the same numerals, only the numerals are double-primed. The second alternate embodiment mask is generally designated by the numeral 10''. Mask 10'' has a shell 40 formed to have a hump-shape so as to enclose the nose and mouth, but not contact them, similar to material layer 16 of mask 10. Shell 40 includes a window-like frame 42 for receiving a layer of first materials 44 which function to filter dust and other particulates from air. A cover 46 holds layer 44 in place.

Shell 40 has a perimeter 22". A strip 30" the same as strip 30 is fastened with adhesive or other known fastening mechanism to shell 40 near perimeter 22". Similarly, a third material 32" the same as material 32 is fastened to both strip 30" and shell 40, leaving one side of strip 30" exposed to allow air to be forced from or absorbed into the open cell foam material. As discussed with respect to the preferred embodiment, material 32", therefore, forms a particulate impenetrable seal between the face and shell 40, while yet allowing the open cell foam strip 30" to compress or expand as necessary.

Strap holders 48 are preferably made of the same material as shell 40 and form an integral part with it.

In a location approximately directly forwardly from where the mouth of the wearer of mask 10" would be, frame 42 is formed. The size of frame 42 is not critical, as long as it is sufficiently large to allow sufficient air to the wearer during respiration for all respiration rates of the wearer. Frame 42 includes a flange 52 about its periphery. In addition, cross members 54 extend between pairs of opposite sides to form a grid across the opening 56. Layer 44 of filter sheets fit within and completely fill opening 56. A strip of adhesive or a sealing gasket (not shown) along the outer perimeter of layer 44 may be used to attach layer 44 to the outer edge 57 of opening 56 to insure that dirty air cannot bypass filtering layer 44 when passing from the outside of shell 40 to a space enclosed by it.

Cover 46 fits over layer 44 and attaches to flanges 52 of frame 42. Cover 46 is formed to have a rectangular frame 58 with cross members 60 and flanges 62 along preferably only one pair of opposite sides. Cover 46 is preferably slightly arcuate between flanges 62 so that flanges 62 may be separated when cover 46 is placed over frame 42. In this way, flanges 62 frictionally engage mating walls of flange 52.

In use, mask 10" is placed over the nose and mouth of the wearer and appropriate straps fitted around the wearer's head snugly. Strip 30" compresses as appropriate and third material 32" forms a seal as appropriate, both functions being adequately described hereinbefore with respect to the preferred embodiment. A pad of layer 44 is placed in the enclosure defined by flange 52 of frame 42. Cover 46 is bent slightly so that flanges 62 fit over opposite walls of flange 52 to hold layer 44 between cross members 54 and 60. The pad of layer 44 sheets may be installed in this fashion before or after mask 10" is placed on the wearer.

Mask 10" is particularly advantageous since shell 40 is relatively rigid and maintains its shape over extended use, even when it gets wet through perspiration or otherwise. The rigidity of shell 40 allows the straps of mask 10" to be snugged as desired and, therefore, to compress strip 30" perhaps more than one would with strip 30 of the preferred embodiment. In addition, sufficient filtering area is provided to allow more than adequate airflow for respiration. Also, layer 44 is readily replaceable so that unclogged filtering sheets can be installed whenever needed. In contrast, a mask as disclosed for the preferred embodiment must be discarded whenever the filtering materials becomes sufficiently dirty.

Figure 8:
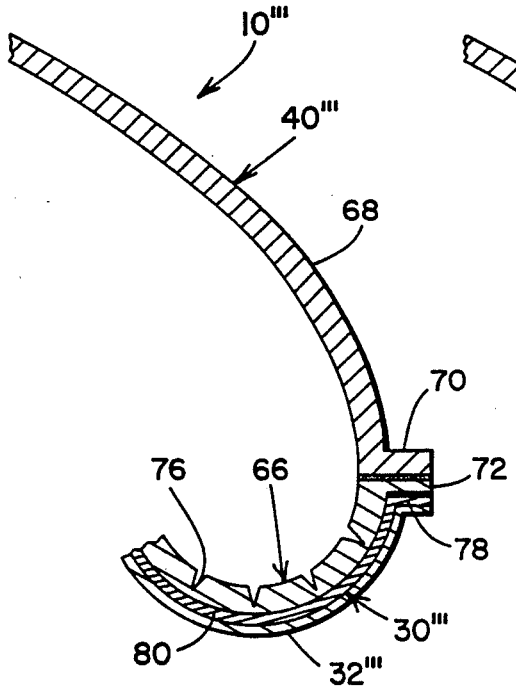
FIG. 8 is a cross-sectional view of still a further alternate embodiment mask in accordance with the present invention, showing a support member with fingers and an adhesive attaching mechanism.

A third alternate embodiment of the present invention is shown in FIG. 8. The third alternate embodiment mask is generally designated by the numeral 10'''. Mask 10''' is constructed similar to masks 10 and 10" as described hereinbefore, except for a support member 66 and the changes in shape and attaching mechanism due to its use. Mask 10''' is shown to have a shell 40''' similar to shell 40 of the second embodiment 10". It is understood, however, that a formed hump-shaped, filter material as shown in FIG. 3 for mask 10 is also appropriate for use in the present embodiment. Shell 40''' has a dome-like shape 68 which would include a frame, filter material, and cover (not shown) like that described with respect to mask 10". A flange 70 extends outwardly from dome 68.

Figure 10:
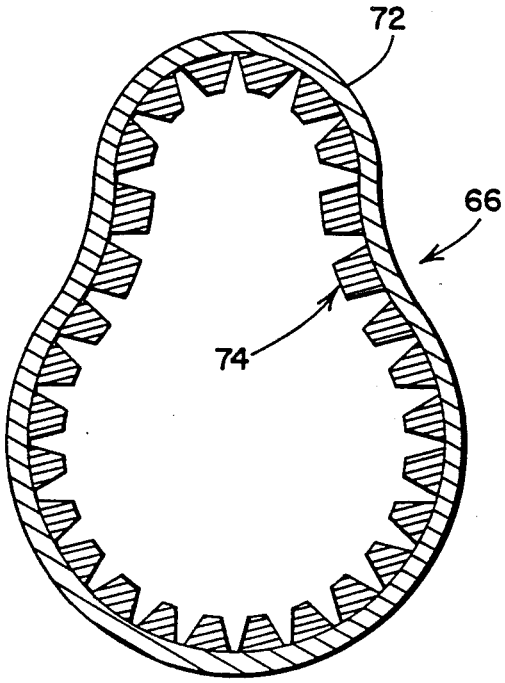
FIG. 10 is a bottom plan view of the support member with fingers as used in the embodiment of FIGS. 8 and 9.

Support member 66 provides a relatively firm, yet flexible support for a strip 30''' of preferably open-cell foam material and an endless layer of sealing third material 32'''. It is noted that strip 30''' need not be an open celled foam in this embodiment, but may be any easily compressible material. Support member 66 is shown in bottom plan view in FIG. 10. Support member 66 includes a firm, endless flat strip 72 to fit against flange 70. Extending inwardly from strip 72 are a plurality of slightly spaced-apart fingers 74. Each finger 74 has an arcuate shape with curvature being convex opposite from dome 68. Each finger preferably includes a plurality of transverse grooves 76 which allow easier flexing than would otherwise be the case. Support member 66 is fairly stiff relative to foam material 30'''. Support member 66 is preferably made from a neoprene rubber having a durometer hardness of 50 to 70. Strip 32''' has characteristics as described hereinbefore, except it is shaped to initially conform with support member 66. That is, strip 30''' has a thermally compressed flat flange 78 for fitting adjacent to strip 72. The pliable face conforming portion 80 of strip 30''' extends arcuately from flange 78 to conform with the arcuate shape of fingers 74. Portion 80 extends from flange 78 to at least the free end of fingers 74.

The sealing third material 32''' is attached to the side of strip 30''' facing away from shell 40'''. Third material 32''' has characteristics as described hereinbefore and extends from the free end of flange 78 to the free end of portion 80.

In the embodiment of FIG. 8, mask 10''' has adhesive layers for attaching the flange of support member 66 to the flange of shell 40''' and the flange of foam strip 30''' to the flange of support member 66. Straps are attached to shell 40''' in a representative fashion as shown in FIG. 6.

To use, mask 10''' is placed over the nose and mouth of the wearing person and straps are extended around his head. The straps are adjusted so that the third material 32''' at least a part of the third material contacts the person's face all along the endless path of the third material.

Furthermore, strip 30''' should be at least partially compressed and at least some of fingers 74 flexed inwardly. The advantage of mask 10''' is that both foam strip 30''' and fingers 74 compress or flex as appropriate to conform sealing third material 32''' snugly against the face of the wearer. Furthermore, as the configuration of the person's face changes due to smiling, grimacing, talking, breathing, etc., there is a greater yielding distance available through which a compressive force will be applied by fingers 74 and foam strip 30''' to keep sealing third material 32''' against the wearer's face.

Figure 9:
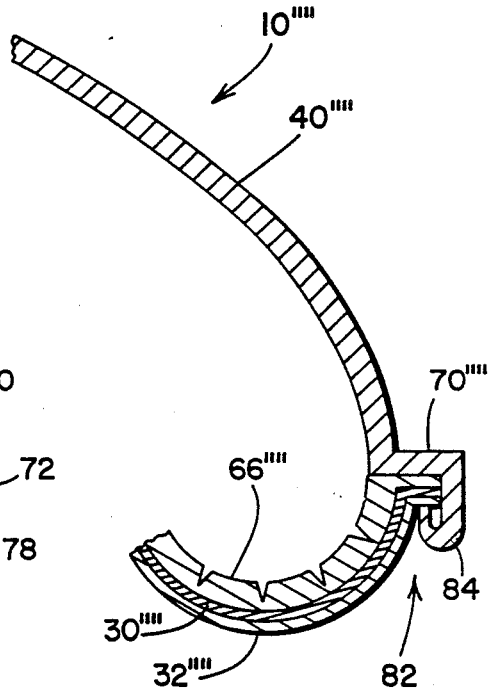
FIG. 9 is a cross-sectional view similar to FIG. 8 showing a crimp attachment mechanism.

Mask 10'''' as shown in FIG. 9 is similar to mask 10''', except a crimp 82 provides the attaching mechanism. That is, the end portion 84 of flange 70''' is formed under heat or other radiation (i.e., sonic) to clamp the flange portions of sealing third material 32'''', foam strip 30'''', and support member 66'''' against flange 70''''.

The method of manufacture of the present invention is particularly advantageous since the sealing third material is applied to the foam strip as liquid and allowed to cure thereon. In this way, the integrity of the fastening joint between the two materials is highly reliable and reduces any concern with leakage to the attachment mechanism to the mask shell or filter material, depending on the embodiment, and to the contact between the sealing third material and the wearer's face. In the first three embodiments, the sealing material is placed in contact with the shell or filter material and cured thereon. In the embodiments of FIGS. 8 and 9, an adhesive or a crimping is used. In each case, the attachment mechanism can be tightly controlled and tested. Furthermore, the design of the present mask specifically addresses enhancing seal integrity between the sealing third material and the face of the wearer. As a consequence, the sealing efficiency of the present technology is superior relative to the industry.

With respect to manufacture, the filter material or shell is manufactured in ways known to those skilled in the art. The foam strip is created first by molding a loaf having a desired side wall shape. The loaf is cut into bread-like slices. Then as illustrated in FIG. 11, each slice 86 is cut with dies 88 and 90 to form an endless strip 92. Strip 92 is shown in FIG. 12 to be thermoformed. Thermoforming is needed with respect to the embodiments of FIGS. 8 and 9 so that the foam strip can conform in shape with support member 66. With respect to the embodiments of FIGS. 4, 5 and 6, (generally no further forming is needed after the die cutting step.) In any case, as shown in FIG. 12 heat elements represented by the numerals 94 and 96 form strip 92 as desired. Elements 94 and 96 are shown to be energized electrically through a battery and switch to ground. It is noted that support member 66 is preferably injection molded using a neoprene rubber material.

With respect to the embodiments of FIGS. 4–6, the foam strip would be attached to the filter material, rigid frame, or shell, depending on the embodiment, with the indicated item held as appropriate by a holder so as to mask the portion of the foam material which is not covered by the sealing third material. With reference to foam strip 30''', a holder 98 is illustrated in FIG. 13. A nozzle 100 is shown spraying a liquid rubber onto the exposed surface 102 of strip 30'''.

Figure 14:
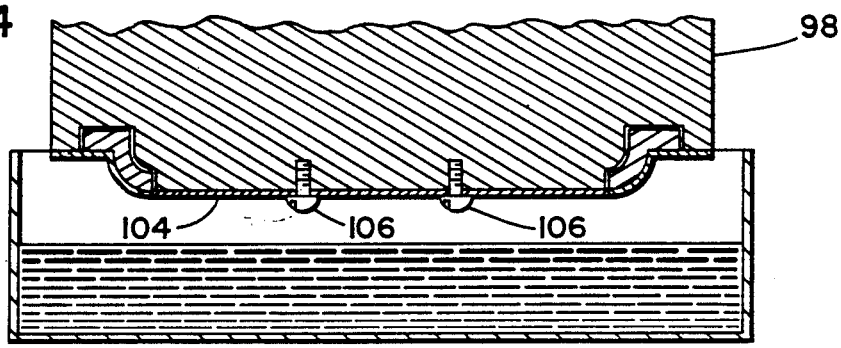
Figure 15:
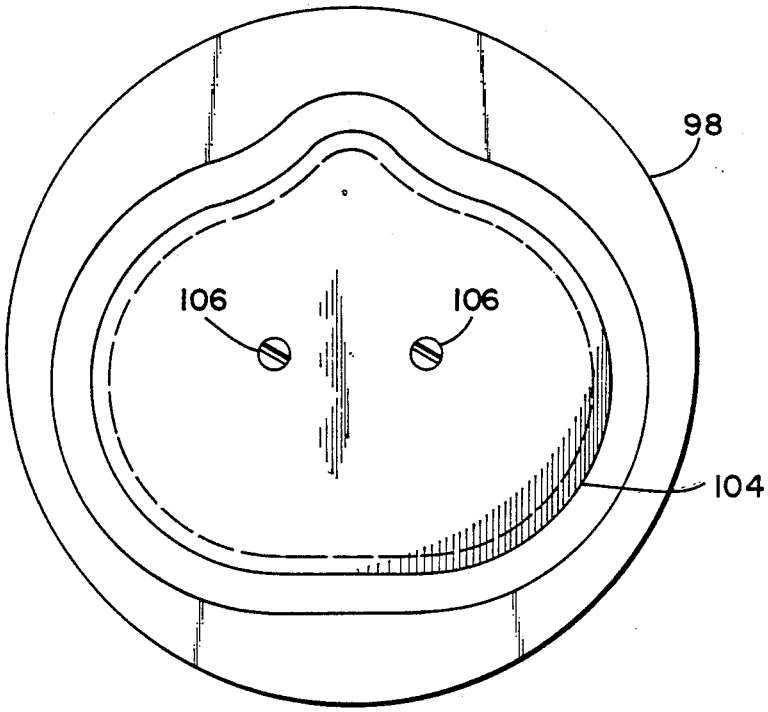
Figure 16:
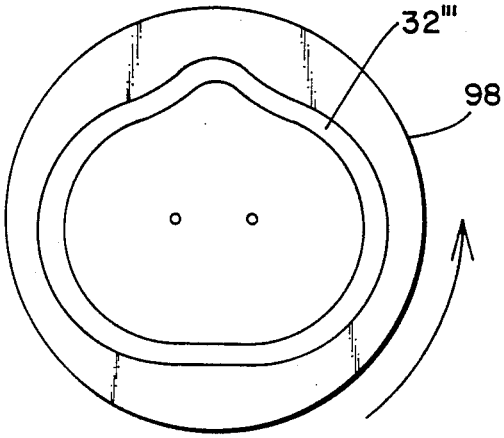

Alternately, as shown in FIGS. 14 and 15, a cap 104 can be fastened with fastening devices 106 to holder 98 so that the holder may be inverted and dipped to coat the exposed side of strip 30''' to liquid rubber of a type described hereinbefore for creating sealing third material 32'''. After dipping, cap 104 is removed and holder 98 is spun, as illustrated in FIG. 16, so that the liquid rubber before curing, can flow and evenly coat the exposed surface of foam strip 30'''. After the rubber of sealing third material 32'' has cured, strip 30''' is removed and attached to, for example, shell 40''' as shown in FIG. 8, with an adhesive. Alternately, strip 30'''' is fastened to shell 40'''' with a crimp. Other steps needed to complete the manufacture of a mask are conventional.

Because of the very soft third material rubber required by the mask of the present invention, it must be fitted and attached to the foam strip when it is in a liquid form.

Thus, the preferred and alternate embodiments and method of manufacture of the present invention have hereby been disclosed in detail and advantages of structure and function and steps needed for the manufacture pointed out. It is understood, however, that the embodiments are only exemplary of other possible equivalent embodiments. Therefore, it is understood that changes made, especially in matters of shape, size, arrangement, order of steps, etc., to the full extent extended by the general meaning of the terms in which the appended claims are expressed, are within the spirit and principle of the present invention.

What is claimed is:

1. A mask, comprising, means for filtering dust and other particulates from air, said filtering means forming a hump-shaped, pliant layer of material, said layer having an irregularly shaped perimeter to conform substantially to a person's face so that said layer enclosed said person's nose and mouth, means for sealing between said filtering means and said person's face, said sealing means including an endless strip of foam-like, second material, said strip having a rectangular cross-sectional shape with four sides, the first of said sides being attached to said filtering means near said perimeter, a second of said sides being opposite said first side, the second side of said second material expanding and contracting to conform to the irregularities in said person's face as the face moves through different expressions, said sealing means further including a third material, said third material being elastic and impermeable to air, said third material being hermetically sealed endlessly to at least a portion of said second side and a portion of said first material adjacent to said third side, said third material being a thin elastic layer and sufficiently soft that said third material cannot support its own weight so that said third material readily stretches and takes on the shape of said second material at localized segments thereby allowing said second material to conform to the variable irregularities of the face while yet allowing said third material to seal effectively along its complete endless path;

as a separate piece a semi-rigid stiffening frame member fastened between said hump-shaped layer on one side of the frame member and said second and third materials on another side of the frame member;

a strap attached to said filtering means for wrapping about said person's head to hold said filtering means to enclose said person's nose and mouth so that said second material compresses and so that said third material directs air forced out of and absorbed into said second material through a fourth of said sides, thereby preventing contaminated air from bypassing said filtering means through said sealing means.

2. A mask in accordance with claim 1 wherein said enclosing means includes a semi-rigid shell, said shell having a frame defining an opening, said filtering means including a pad of said first filter material fitting in said frame, said filtering means further including a cover holding said pad in said frame.

3. A mask in accordance with claim 1 wherein said enclosing means includes a hump-shaped, plain layer of said first filter material, said layer extending to said perimeter, said mask including a semi-rigid frame with first and second sides, the first side being fastened to the first material of said hump-shaped layer and the second side being fastened to said second material.

4. The mask in accordance with claim 1 wherein said third material consists of latex rubber.

5. The mask in accordance with claim 1 wherein said third material consists of styrene-butadiene.

6. A mask, comprising, a dome means for enclosing a person's nose and mouth, said enclosing means having an irregularly shaped perimeter to substantially conform to said person's face and surround said person's nose and mouth, said enclosing means including means for filtering dust and other particulates from air;

an endless support strip adjacent to said perimeter of said enclosing means, said endless support strip having a plurality of flexible, cantilevered fingers extending into said enclosing means;

said endless support strip having an arcuate portion with the curvature thereof being convex opposite from said dome means, said arcuate portion includes a rearwardly extending outer wall portion which projects toward the face of a user and said arcuate portion being curved centrally of the mask from the outer wall portion and thence forwardly to provide a forwardly extending wall portion that presses toward the face with a free edge that extends forwardly, the forwardly extending free edge of the arcuate portion being separated into a plurality of circumferentially spaced apart portions defining said cantilevered fingers, said finger being separated from one another by means of a plurality of rearwardly extending circumferentially spaced apart notches in the endless support strip, said fingers being thereby individually and separately yieldable in an outward direction and each exerting a centrally directed force toward the face;

means for sealing between said enclosing means and said person's face, said sealing means resting on said fingers, said sealing means being impermeable to air;

means for attaching said enclosing means, said endless support strip, and said sealing means together; and means, attached to said enclosing means, for holding said sealing means against the face, said endless support strip and the fingers thereof being fairly stiff relative to said sealing means whereby compression is applied by the cantilevered finger portions of the supporting strip to the sealing means so that the fingers flex to conform to the face and press the sealing means snugly against the face of the wearer.

7. A mask in accordance with claim 6 wherein said enclosing means includes a semi-rigid shell, said shell having a frame defining an opening, said filtering means including a pad of filter material fitting in said frame, said filtering means further including a cover holding said pad in said frame.

8. The mask in accordance with claim 6 wherein said enclosing means includes a hump-shaped, pliant layer of filter material, said layer extending to said perimeter.

9. The mask in accordance with claim 7 wherein said sealing means includes means for pliably conforming to said person's face, said conforming means including an endless strip of open-cell foam material or the like, said foam material having a side facing away from said fingers, said foam material being permeable to air, said side being covered by an elastic material being impermeable to air.

10. The mask in accordance with claim 9 wherein said elastic material consists of latex rubber.

11. The mask in accordance with claim 9 wherein said elastic material consists of styrene-butadiene.

12. The mask in accordance with claim 6 wherein said attaching means includes an adhesive layer.

13. The mask in accordance with claim 6 wherein said attaching means includes one portion of said enclosing means clamping said endless support strip and said sealing means against a second endless portion of said enclosing means.

* * * * *